US006115004A

United States Patent [19]

McGinnis

[11] Patent Number: 6,115,004

[45] Date of Patent: Sep. 5, 2000

[54] ANTENNA SUPPORT SYSTEM

[76] Inventor: Henry J. McGinnis, 7241 Martha La., Fort Worth, Tex. 76112

[21] Appl. No.: 09/191,700

[22] Filed: Nov. 13, 1998

[51] Int. Cl.[7] ..... H01Q 1/12

[52] U.S. Cl. ..... 343/890; 343/771; 343/891

[58] Field of Search ..... 343/771, 890, 343/891, 892; H01Q 1/12

[56] References Cited

U.S. PATENT DOCUMENTS

| | | | |
|---|---|---|---|
| 2,807,018 | 9/1957 | Woodward, Jr. . | |
| 4,342,474 | 8/1982 | Sewell et al. | 285/61 |
| 5,546,096 | 8/1996 | Wada | 343/771 |
| 5,649,402 | 7/1997 | Moore | 52/651.02 |
| 5,774,193 | 6/1998 | Vaughan | 348/723 |
| 5,831,583 | 11/1998 | Lagerstedt et al. | 343/771 |
| 5,954,305 | 9/1999 | Calabro | 248/219.4 |

OTHER PUBLICATIONS

TRASAR product literature; Andrew.
ALP Series product literature; Andrew.
ALP Series product literature; Andrew.
ALPac System product literature; Andrew.
Wireless Cable product literature; Andrew.
TLP Series product literature.

*Primary Examiner*—Don Wong
*Assistant Examiner*—Shih-Chao Chen
*Attorney, Agent, or Firm*—Felsman, Bradley, Vaden Gunter & Dillon, LLP; James E. Bradley

[57] ABSTRACT

An antenna support for a communications tower has three or more vertical steel legs which are joined along their lengths by nonmetallic lattice members. The lattice members include horizontal braces and diagonal nonmetallic wires. At least one digital or analog antenna is mounted to one or more legs of the antenna support. Alternatively, each leg may function as an antenna and contain a number of wave guides. The legs are cylindrical and slots are milled in each leg for enhancing the performance of the wave guides. The total number of slots and their spacing may vary as a function of the frequency and pattern direction of the wave guides.

15 Claims, 3 Drawing Sheets

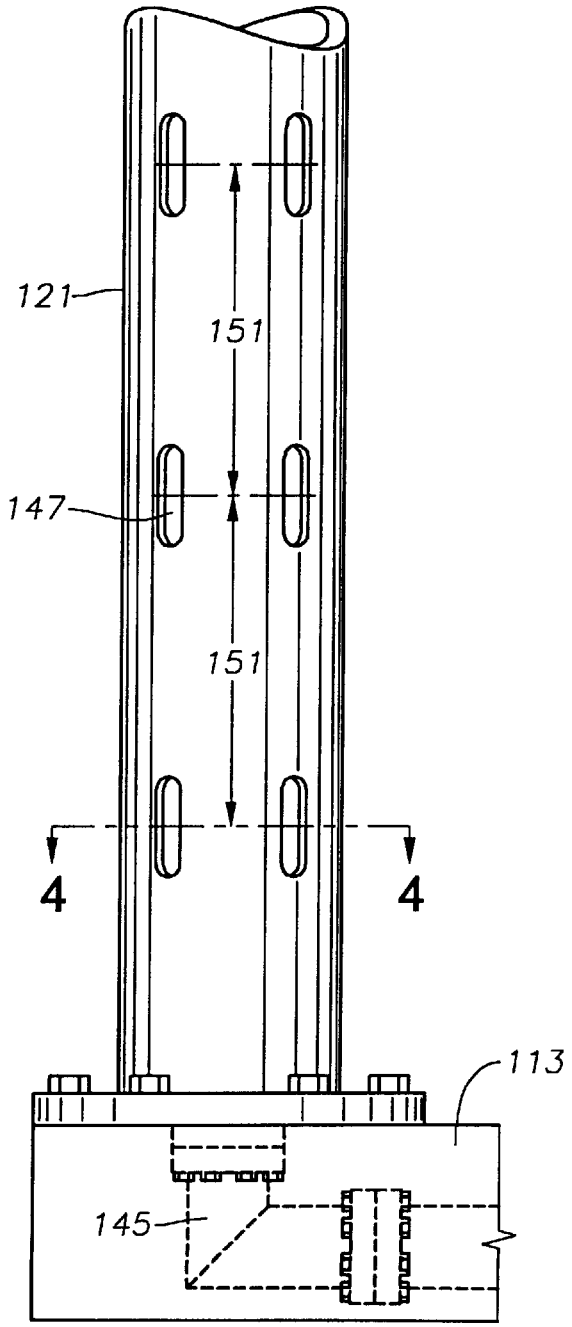
Fig. 3
Fig. 4
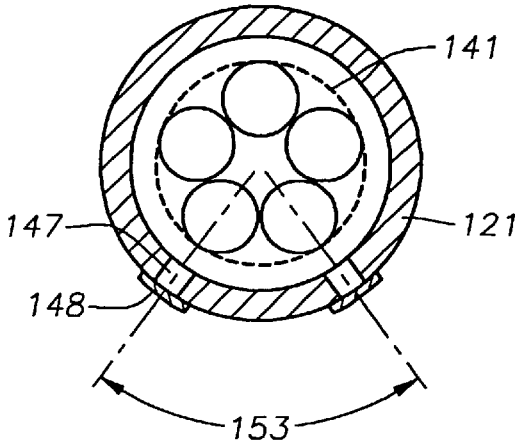

ANTENNA SUPPORT SYSTEM

TECHNICAL FIELD

This invention relates in general to communications towers and in particular to a digital or analog antenna support.

BACKGROUND OF THE INVENTION

Antenna supports are typically used to mount digital and/or analog antennas to communications towers. In the prior art, antenna supports are typically formed from steel trusses, pipes and guy supports. These steel members can detrimentally affect the signals received and transmitted from the individual antennas. In some areas, such as residential or high visibility areas, communication tower antenna supports which are less conspicuous or which have a slender profile are desirable. An antenna support which incorporates one or both of these features is needed.

SUMMARY OF THE INVENTION

An antenna support for a communications tower has three or more vertical steel legs which are joined along their lengths by nonmetallic lattice members. The lattice members include horizontal braces and diagonal nonmetallic wires. At least one digital or analog antenna is mounted to one or more legs of the antenna support. Alternatively, each leg may function as an antenna and contain a number of wave guides. The legs are cylindrical and slots are milled in each leg for enhancing the performance of the wave guides. The total number of slots and their spacing may vary as a function of the frequency and pattern direction of the wave guides.

BRIEF DESCRIPTION OF DRAWINGS

FIG. 3 is a partial enlarged side view of one pipe of the antenna support structure of FIG. 2.

FIG. 4 is a sectional end view of the pipe of FIG. 3 taken along the line 4—4 of FIG. 3.

BEST MODE FOR CARRYING OUT THE INVENTION

Figure 1:
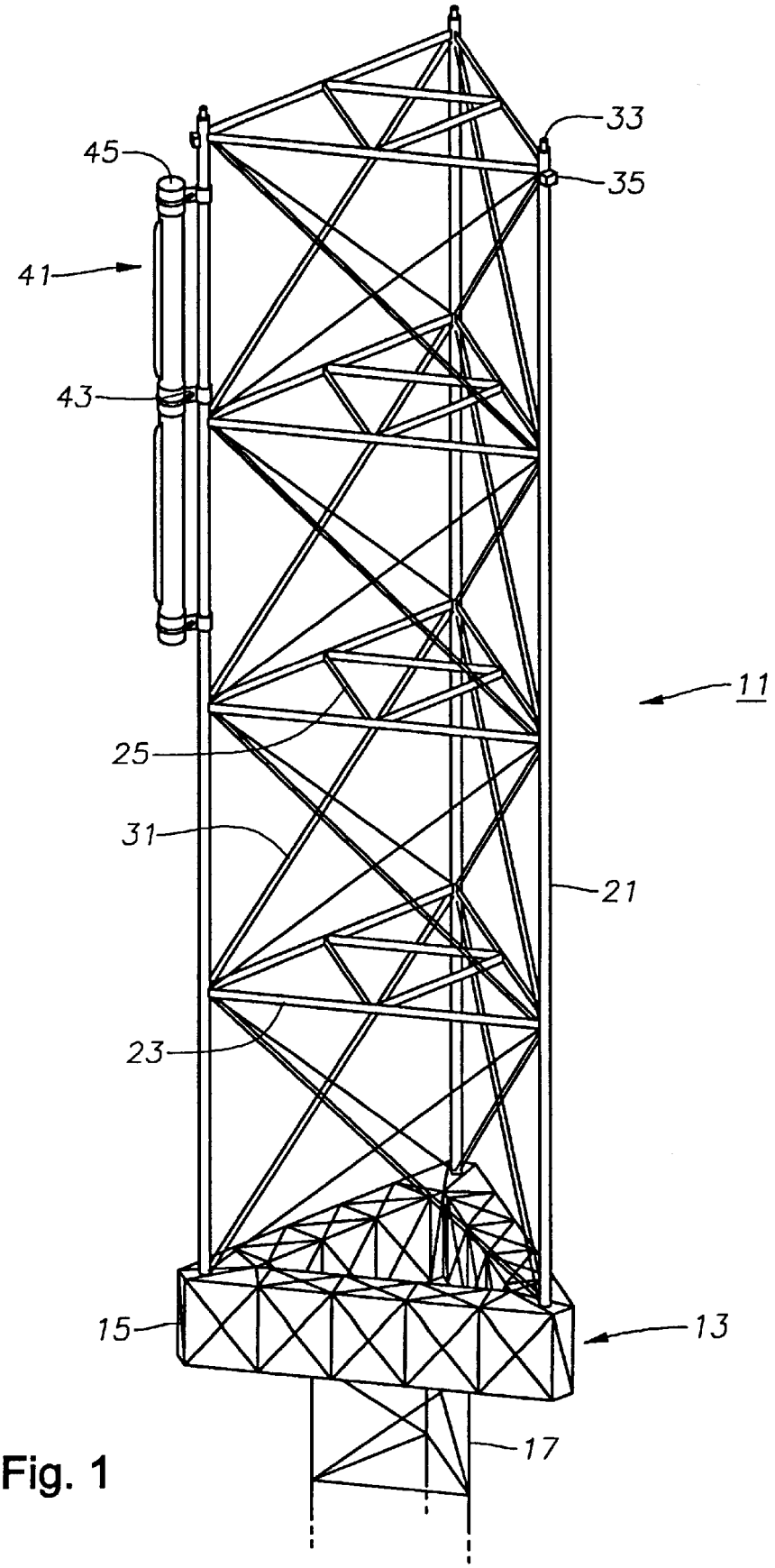
FIG. 1 is an isometric view of an antenna support structure mounted to the top of a conventional communications tower and is constructed in accordance with the invention.

Referring to FIG. 1, an antenna support 11 is shown. Antenna support 11 may be provided with a steel truss 13 on its lower end. In the embodiment shown, truss 13 is generally triangular in shape and has a height of approximately ten feet, but the shape and height may vary. Truss 13 is parallel to the ground below and comprises a large number of interlocking braces or struts 15 for additional strength. Truss 13 is provided for mounting antenna support 11 to the upper end of a conventional communications tower 17. Tower 17 extends upward from the ground and is typically supported by a plurality of guy wires (not shown). Tower 17 may be free standing as well.

Antenna support 11 comprises three or more cylindrical steel legs or pipes 21 which extend vertically upward from the triangular corners of truss 13. Pipes 21 are parallel to one another. In one embodiment, each pipe 21 is approximately twelve inches in diameter and 130 feet long. Pipes 21 are interconnected by nonmetallic lattice members. The lattice members may be of various configurations, and include a plurality of horizontal, triangular braces or channels 23 located above and parallel to truss 13. Channels 23 are also perpendicular to and join pipes 21. Channels 23 are formed in sets of three, defining a triangular configuration. Each end of each channel 23 is fastened to a pipe 21. Channels 23 are symmetrically spaced apart relative to one another and are formed from a nonmetallic composite material such as fiberglass. The uppermost channel 23 may be formed from steel for additional strength. An inverted triangular support member 25, made up of three braces, is located in the interior of the three braces comprising each channel 23. Each corner of support member 25 is fastened to and bisects one of the horizontal braces of its respective channel 23. In the preferred embodiment, support members 25 are also formed from a composite fiber material.

Antenna support 11 also comprises a plurality of diagonal guy supports 31. Each guy support 31 comprises two parallel, nonmetallic composite fiber wires connected in tension. One guy support 31 extends diagonally between an end of each horizontal channel 23 to an opposite end of the horizontal brace 23 located above. Adjacent guy supports 31 cross each other in an "x" configuration, connecting the other ends of the horizontal braces 23. Thus, two guy supports 31 extend between each horizontal brace 23 and the next one above. In addition, two guy supports 31 extend downward from each of the ends of the lowermost set of horizontal braces 23 to the opposing corners of truss 13 where they intersect legs 21. A red beacon 33 and a strobe 35 are mounted to the upper end of each pipe 21 near the uppermost channel 23.

Antenna support 11 is provided for mounting a plurality of conventional digital or analog antennas 41 (only one shown) along the outer edges of pipes 21. Each antenna 41 has a nonmetallic body that is generally cylindrical in shape. At least two brackets 43 secure antenna 41 to one of pipes 21 on antenna support 11. The body of each antenna 41 houses waveguides which are oriented to receive and/or transmit signals from directions away from antenna support 11. Although the waveguides are not shown in FIG. 1, they are further described in connection with the second embodiment. The wave guides are contained with a housing 45 which is a tubular member mounted parallel to leg 21. In the preferred embodiment (not shown), antenna support 11 may support multiple antennas 41 on each pipe 21. When properly installed, antennas 41 are vertically aligned and parallel to pipes 21.

Figure 2:
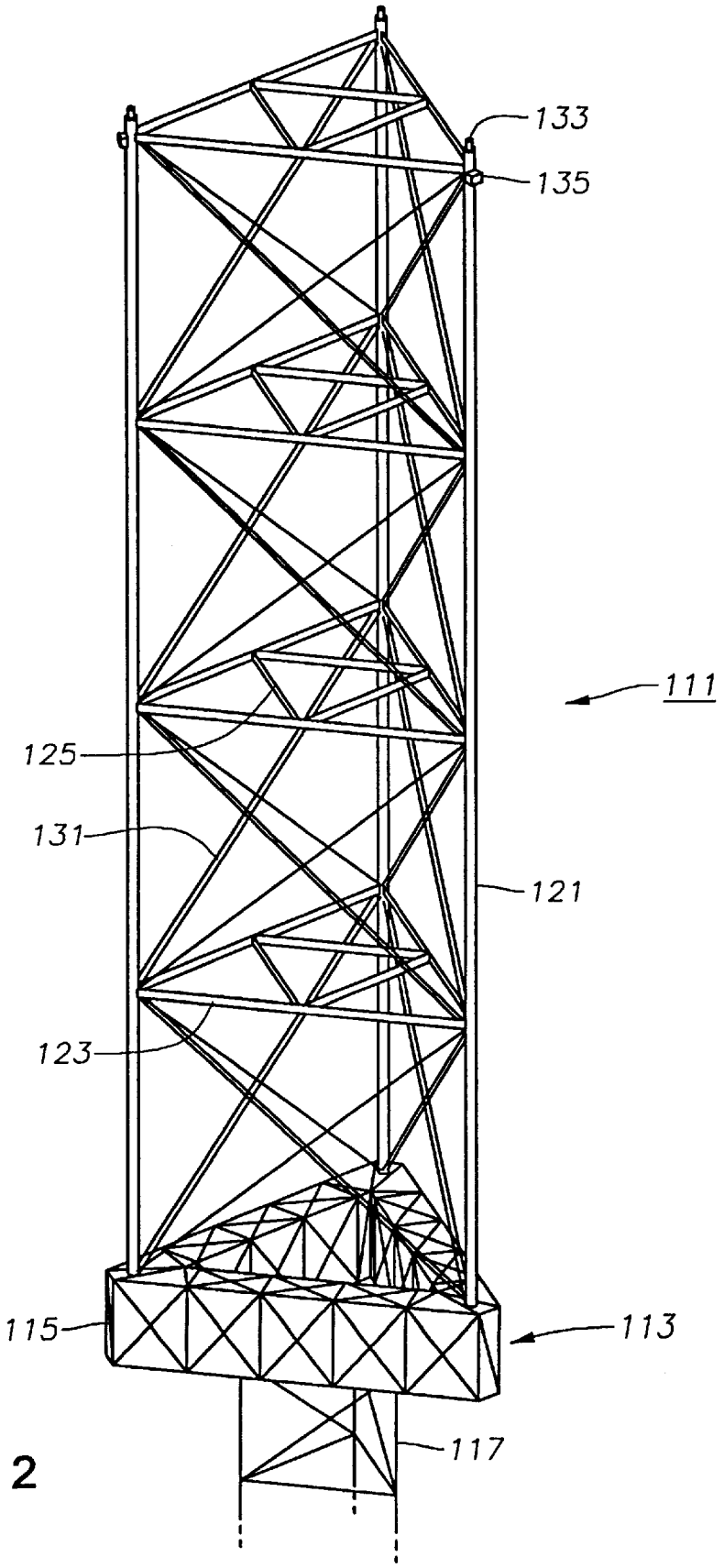
FIG. 2 is an isometric view of a second embodiment of the antenna support structure of FIG. 1.

Referring to FIG. 2, a second embodiment of the invention is shown. An antenna support 111 is provided with a steel truss 113 on its lower end. In the embodiment shown, truss 13 is generally triangular in shape and has a height of approximately ten feet, although the configuration and height may vary. Truss 13 is parallel to the ground below and comprises a large number of interlocking braces or struts 115 for additional strength. Truss 113 is provided for mounting antenna support 111 to the upper end of a conventional communications tower 117. Tower 117 extends upward from the ground and is typically supported by a plurality of guy wires (not shown). Tower 117 may be free standing as well.

Antenna support 111 comprises a plurality of hollow, parallel legs or pipes 121 which extend vertically upward from the triangular corners of truss 113. Pipes 121 may be formed from steel, aluminum or other nonconductive materials such as fiberglass. Pipes 121 are load supporting, and, in one embodiment, each pipe 121 is approximately twelve inches in diameter and 130 feet long.

Antenna support 121 also has a plurality of braces or channels 123, support members 125, and guy supports 131. These components are identical to channels 23, support members 125 and guy supports 131, and are connected to pipes 121 in the same manner described above for legs 21.

Referring now to FIGS. 3 and 4, each pipe 121 functions as an antenna and contains a plurality of wave guides 141 therein. Each wave guide 141 is generally cylindrical in shape and is bundled with other wave guides 141 inside pipe 121. In the embodiment shown, antenna support 111 may support multiple antennas within each pipe 121. When properly installed, portions of wave guides 141 are vertically aligned and parallel to pipes 121. A conduit 145 at the lower end of each pipe 121 serves as a housing for a transmission line (not shown) and/or wave guide 141. The transmission line extends between tower 117 and a transmitter (not shown).

A plurality of slots 147 are milled in each pipe 121 at precise intervals. Slots 147 are organized individually or in pairs and are provided for enhancing the performance of wave guides 141. Pipes 121 and waves guides 141 are designed to get wave/signal fronts to each slot 147 at approximately the same time.

Each slot 147 is closed or sealed with a thin fiberglass or a similar nonmetallic seal 148 (FIG. 4). Each pair of adjacent slots 147 is vertically spaced apart from one another by a precise dimension 151 (FIG. 3). Dimension 151 and the total number of slots 147 may vary as a function of the frequency and pattern direction of wave guides 141. Each pair of slots 147 is also offset from one another by a precise angular dimension 153 (FIG. 4). Dimension 153 and the total number of slots 147 may vary as a function of the pattern direction of wave guides 141. Thus, although in the embodiment shown pipe 121 has six slots 147, pipe 121 could contain more or fewer slots 147 which are vertically and angularly spaced apart at greater or lesser dimensions.

The invention has several advantages. The antenna supports disclosed are strong, lightweight structures that may be formed from a variety of materials. The use of nonmetallic lattice members, rather than steel, avoids detrimentally affecting the signals received and transmitted from the individual antennas. The slots milled in each pipe shield the antenna in a slender profile while enhancing the performance of the wave guides. The pipes and waves guides are designed to get wave and signal fronts to each slot at approximately the same time. The slots also may be custom designed for any application, depending upon the frequency and pattern direction of the wave guides.

While the invention has been shown or described in only some of its forms, it should be apparent to those skilled in the art that it is not so limited, but is susceptible to various changes without departing from the scope of the invention.

I claim:

1. An antenna support for mounting to an existing communications tower, comprising:

a truss adapted to be mounted on top of the existing communications tower such that an entire weight of the antenna support is carried by the existing communications tower;

a plurality of legs which are parallel to one another, the legs extending upward from the truss;

a plurality of nonmetallic lattice members which interconnect the legs to each other; and a set of wave guides mounted to at least one of the legs to form an antenna.

2. The antenna support of claim 1 wherein:

said at least one of the legs is cylindrical;

wherein the set of wave guides is mounted inside said at least one of the legs; and wherein the antenna support further comprises:

a plurality of slots in said at least one of the legs, the set of wave guides being aligned with the slots for enhancing the performance of said wave guides.

3. The antenna support of claim 1 wherein each of the legs is formed from a nonmetallic composite material.

4. The antenna support of claim 1 wherein each of the legs is formed from steel.

5. The antenna support of claim 4 wherein the wave guides are contained with a housing mounted to said at least one of the legs.

6. The antenna support of claim 5 wherein the housing is a tubular member mounted parallel to said at least one of the legs.

7. The antenna support of claim 1 wherein the lattice members comprise:

a plurality of horizontal, rigid braces mounted between and perpendicular to the legs; and a plurality of diagonal composite fiber wires connected between upper and lower adjacent ones of the braces.

8. The antenna support of claim 7 wherein the diagonal composite fiber wires cross each other in an x-pattern.

9. An antenna support for mounting to an existing communications tower, comprising:

a truss adapted to be mounted on top of the existing communications tower such that an entire weight of the antenna support is carried by the existing communications tower;

a plurality of steel legs which are parallel to one another, the legs extending upward from the truss;

a plurality of nonmetallic lattice members which interconnect the legs to each other;

a tubular housing mounted parallel to one of the legs; and a set of wave guides mounted inside the housing to form an antenna.

10. The antenna support of claim 9 wherein the lattice members comprise:

a plurality of horizontal, rigid braces mounted between and perpendicular to the legs; and a plurality of diagonal composite fiber wires connected between upper and lower adjacent ones of the braces.

11. The antenna support of claim 10 wherein the diagonal composite fiber wires cross each other in an x-pattern.

12. An antenna support for mounting to an existing communications tower, comprising:

a metal truss adapted to be mounted on top of the existing communications tower such that an entire weight of the antenna support is carried by the existing communications tower;

a plurality of tubular legs which are parallel to one another and extend upward from the metal truss;

a plurality of nonmetallic lattice members which interconnect the legs to each other;

a set of wave guides mounted inside at least one of the legs to form an antenna; and a plurality of slots in said at least one of the legs, the set of wave guides being aligned with the slots for enhancing the performance of said wave guides.

13. The antenna support of claim 12 wherein each of the legs is formed from a nonmetallic composite material.

14. The antenna support of claim 12 wherein the lattice members comprise:

a plurality of horizontal, rigid braces mounted between and perpendicular to the legs; and a plurality of diagonal composite fiber wires connected between upper and lower adjacent ones of the braces.

15. The antenna support of claim 14 wherein the diagonal composite fiber wires cross each other in an x-pattern.

* * * * *